US008037922B2

(12) United States Patent
Hawkins et al.

(10) Patent No.: US 8,037,922 B2
(45) Date of Patent: Oct. 18, 2011

(54) DEVICE FOR MONITORING MOTION OF A MOVABLE CLOSURE

(75) Inventors: Ray Hawkins, Victoria (AU); Toan Dang, Victoria (AU)

(73) Assignee: Automatic Technology (Australia) Pty Ltd, Keysborough, Victoria (AU)

( * ) Notice: Subject to any disclaimer, the term of this patent is extended or adjusted under 35 U.S.C. 154(b) by 254 days.

(21) Appl. No.: 12/094,116

(22) PCT Filed: Nov. 16, 2006

(86) PCT No.: PCT/AU2006/001705

§ 371 (c)(1),
(2), (4) Date: Jul. 30, 2008

(87) PCT Pub. No.: WO2007/056800

PCT Pub. Date: May 24, 2007

(65) Prior Publication Data

US 2009/0025298 A1 Jan. 29, 2009

(30) Foreign Application Priority Data

Nov. 18, 2005 (AU) ..... 2005906436

(51) Int. Cl.
*A47G 5/02* (2006.01)
*E05F 11/00* (2006.01)

(52) U.S. Cl. ..... 160/310; 160/188

(58) Field of Classification Search ..... 160/1, 7, 160/23.1, 133, 188, 293.1, 291, 310, 311; 318/266, 466; 340/679–680, 686.1–686.6
See application file for complete search history.

(56) References Cited

U.S. PATENT DOCUMENTS

| | | | | |
|---|---|---|---|---|
| 1,441,229 | A * | 1/1923 | Lacey | 160/310 |
| 2,640,454 | A * | 6/1953 | Kummerman | 114/201 R |
| 4,235,316 | A * | 11/1980 | Blomberg | 188/181 R |
| 4,831,509 | A * | 5/1989 | Jones et al. | 700/90 |
| 4,888,531 | A | 12/1989 | Hörmann | |
| 5,181,891 | A | 1/1993 | Pohl et al. | |
| 5,243,784 | A | 9/1993 | Whitaker et al. | |
| 5,640,007 | A * | 6/1997 | Talbott et al. | 250/231.15 |
| 5,798,681 | A * | 8/1998 | Chang | 336/83 |
| 6,082,433 | A | 7/2000 | Vafaie et al. | |
| 6,155,324 | A * | 12/2000 | Elliott et al. | 160/1 |
| 6,305,457 | B1 * | 10/2001 | Leivenzon et al. | 160/310 |

(Continued)

FOREIGN PATENT DOCUMENTS

AU 200053568 B2 3/2001

(Continued)

*Primary Examiner* — Blair M Johnson
*Assistant Examiner* — Jaime F Cardenas-Garcia
(74) *Attorney, Agent, or Firm* — Finnegan, Henderson, Farabow, Garrett & Dunner, LLP

(57) ABSTRACT

A device for monitoring motion of a movable closure arranged for travel between limit positions, comprising an absolute position encoder for identifying whether the closure is in one of a plurality of sectors of travel, a relative position encoder for monitoring the speed and relative position of the closure, and a drive means for operatively coupling the relative position encoder and the absolute position encoder to the closure, such that there is a fixed relationship between motion of the closure and movement of both encoders, wherein the absolute position encoder features an adjustment assembly comprising a first element and a second element, the first element being selectively adjustable in position relative to the second element to adjust the absolute position encoder without movement of the drive means or the relative position encoder.

18 Claims, 4 Drawing Sheets

U.S. PATENT DOCUMENTS

| | | | | |
|---|---|---|---|---|
| 6,788,048 | B2 * | 9/2004 | Hedayat et al. | 324/202 |
| 6,791,088 | B1 * | 9/2004 | Williams et al. | 250/343 |
| 6,978,822 | B2 * | 12/2005 | Schoonen | 160/310 |
| 7,022,993 | B1 * | 4/2006 | Williams et al. | 250/343 |
| 7,051,782 | B2 * | 5/2006 | Nichols et al. | 160/310 |
| 7,055,283 | B2 * | 6/2006 | Hsieh | 49/139 |
| 7,116,100 | B1 * | 10/2006 | Mock et al. | 324/207.25 |
| 7,299,847 | B1 * | 11/2007 | Evans | 160/1 |
| 2003/0121619 | A1 * | 7/2003 | Szpur | 160/188 |
| 2003/0169034 | A1 * | 9/2003 | Okumura | 324/207.21 |
| 2005/0067119 | A1 * | 3/2005 | Schoonen | 160/310 |
| 2005/0087313 | A1 * | 4/2005 | Nichols et al. | 160/310 |
| 2006/0137833 | A1 * | 6/2006 | Nichols et al. | 160/120 |
| 2006/0243398 | A1 * | 11/2006 | Schoonen | 160/120 |
| 2007/0000622 | A1 * | 1/2007 | Reed et al. | 160/188 |
| 2010/0137802 | A1 * | 6/2010 | Yodfat et al. | 604/152 |

FOREIGN PATENT DOCUMENTS

| | | | |
|---|---|---|---|
| AU | 2004201640 | B2 | 11/2004 |
| AU | 2004226994 | A1 | 6/2005 |
| WO | WO 99/07971 | | 2/1999 |
| WO | WO 2004/044362 | A1 | 5/2004 |

* cited by examiner

DEVICE FOR MONITORING MOTION OF A MOVABLE CLOSURE

FIELD OF THE INVENTION

The present invention relates to a device for monitoring motion of a movable closure. In particular, the present invention relates to a device suitable for use in monitoring and controlling the position and velocity of a powered door or gate, such as a sliding gate, roller door, sectional door or the like, which is arranged for travel between limit positions.

BACKGROUND OF THE INVENTION

In this specification, where a document, act or item of knowledge is referred to or discussed, this reference or discussion is not an admission that the document, act or item of knowledge or any combination thereof was at the priority date part of common general knowledge, or known to be relevant to an attempt to solve any problem with which this specification is concerned.

The drive motor for powered doors, such as roller doors and sectional doors, is operably connected to the door by way of a gear assembly. Rotation of the motor itself is controlled by way of an electrical controller. The controller is commonly operated via a remote control device to allows a user to wirelessly transmit coded signals to the controller to actuate the drive motor so as to open and close the door.

The controller must have knowledge of certain parameters associated with the door, such as its instantaneous position, velocity and direction, to ensure that the drive motor does not move the door into inappropriate or dangerous states. For example, the controller needs to know when the door reaches its travel limits (corresponding to the door being either fully closed or fully open), so that rotation of the drive motor stops when these limits are reached. In addition, the controller must provide or operate in association with obstruction detection means.

One simple way for the controller to identify such parameters is to place physical limit switches in appropriate locations to be contacted by the door as it approaches a travel limit and, in response, to send an electrical signal to the controller causing it to shut off (or possibly reverse the direction of the drive motor.

One such approach is described in published international patent application WO-2004/044362, which describes the encoding of door travel limits by a cam-actuated microswitch. The upper and lower door travel limits are encoded by the microswitch respectively contacting either a ramp portion or a land portion of the cam, with the cam itself being rotated by the epicyclic motion of an eccentric member driven by the drive motor.

More recently, arrangements have been devised whereby door controllers are designed to learn parameters associated with the door, which parameters are stored in a memory device in the controller and utilised by associated control circuitry to efficiently and safely operate the drive motor. Real time readings of the values of continuously varying parameters, in particular displacement and velocity, can be measured by optoelectronic elements and communicated to the controller for use in operating the drive motor.

A controller with learning abilities has advantages over a limit switch solution, as it is a self-contained apparatus and does not require the maintenance of an electrical connection between locations external to the controller itself. The limit switches themselves are also vulnerable to damage through repeated contact with the moving door or by other items that may be present in the door's vicinity.

An example of a learning controller is described in U.S. Pat. No. 4,831,509.

A more sophisticated device is described in published Australian patent AU-200053568. This device employs a position gear having a plurality of radially spaced arcuate protrusions, employed as a gray code position encoder. The wheel is operably coupled to the drive motor, and as the wheel rotates, the interaction between the protrusions and a set of radially directed optical sensors identifies the position of the door as being in one of a plurality of sectors into which the door travel path is divided. The device employs a separate rotatable cutter wheel, arranged to interact with optical sensors coupled to optoelectronic circuitry, in order to identify the instantaneous speed and direction of the door movement. Such a device can be seen as a hybrid door position monitor, as the cutter wheel provides a means of pulse encoding to determine the relative position and speed of movement of the door, whilst the position gear provides an absolute position encoder for the position of the door. Through a learning routine carried out at installation, the controller is provided with sufficient information to know at all times the precise position of the door.

Occasionally (eg. when power is unavailable), a door must be moved by means other than the drive motor. A secondary drive means in this context might be a hand operated chain or similar mechanism, that permits power to be applied to the drive shaft in the event that the drive motor is unavailable. Such a mechanism is described in applicants published Australian patent application AU-2004226994. Alternatively, the door may simply be opened and closed by hand once the drive motor has been disengaged. However, movement of a door by a secondary drive means will result in the controller losing stored knowledge of the position of the door, and it is this essential that the controller is arranged and programmed to immediately relearn the door position in such situations.

The device described in AU-200053568 deals with this problem by moving the door across the nearest sector boundary of the position gear, and then realigning the monitored position from a pre-stored sector transition table. Whilst this device performs well, it is complex and involves a great many individual components, and is thus relatively expensive to manufacture and maintain. It requires five optical sensor elements (and associated electronic circuitry), a multiplicity of aligned, interacting gear wheels, and a relatively complex stored sector transition table. It would be advantageous to provide a simpler and more compact and robust device for identifying parameters associated with a movable closure, or to least offer consumers with a choice of solutions. As the specification of AU-200053568 makes clear on page 6, the only way to change the relationship between the position gear and the door location is to disengage the ring gear from the door.

SUMMARY OF THE INVENTION

According to a first aspect of the present invention there is provided a device for monitoring motion of a movable closure arranged for travel between limit positions, comprising:

- an absolute position encoder for identifying whether the closure is in one of a plurality of sectors of travel;
- a relative position encoder for monitoring of the speed and relative position of the closure; and
- a drive means for operatively coupling the relative position encoder and the absolute position encoder to the closure, such that during operation there is a fixed relationship between motion of the closure and movement of both encoders;

wherein the absolute position encoder includes an adjustment assembly comprising a first element and a second element, the first element being selectively adjustable in position relative to the second element to allow adjustment of the absolute position encoder without movement of the drive means or the relative position encoder.

This serves to provide a very simple hybrid encoder that is selectively (eg. manually) adjustable to a predetermined position. In particular, the absolute position encoder can be set so that a sector transition corresponds to a particular position of the closure, and the travel limits are then represented by a relative distance (as monitored by the relative position encoder) from this position. Overall, the present invention affords a significantly less complex construction than the prior art devices discussed above, with fewer moving parts, whilst at the same time providing comparable accuracy in terms of identification of closure motion parameters.

Both encoders may comprise wheels. The relative position encoder may be a toothed wheel associated with at least one optical sensor. The absolute position encoder may include a rotatable body and a projection from a part of the body, associated with at least one optical sensor. The projection may be a Range projecting radially from a part of the circumference of the body.

Other forms of absolute position encoder are of course possible, such as the use of cutout or transparent portions in a rotatable body, associated with one or more optical or other sensor.

In a preferred form, the absolute position encoder divides the closure travel into two sectors of travel, a first and a second sector. The absolute position encoder may include a radially extending flange of a substantially semicircular form (ie. occupying around 180° of the circumference of the encoder body).

The adjustment assembly may take any convenient form that allows selective adjustment of the position of the first element with respect to the second element, without affecting the position of the relative position encoder.

In one form, the adjustment assembly includes clutch means affording disengagement of the first element from operative engagement with the second element, and means for rotating the first element.

Preferably, the dutch means includes a ratchet assembly having two sets of complementary interlocking teeth respectively on the first and second element, held in meshing engagement by a spring means.

The means for rotating the first element may include a shaft arranged for fixed rotation with the first element, the shaft including means for manual rotation by a user. For example, the shaft may feature a screwdriver slot or other keyway, or may have a knurled extremity or handle means.

In a preferred form, the device includes indicating means for indicating to a user when the first element of the absolute position encoder has been adjusted into a particular orientation. The indicating means may be an LED or other visual indicator coupled to the sensor means configured to light upon detection of a particular orientation of the absolute position encoder. In particular, the particular orientation may be the alignment of the encoder sensor with the sector transition as represented by an edge of the projection from the absolute position encoder body.

It will be realised that, with a two-sector position encoder, the indicating means allows the user to rotate the first element until the point at which the LED switches on or off, thus indicating attainment of the precise sector transition point, relative to which the position of the closure (as monitored by the relative position encoder) can now be referred.

Preferably, the absolute position encoder is configured such that a full revolution of the absolute position encoder corresponds to travel of the movable closure over a distance greater than the distance between the closure limit position. The first sector (less than a half revolution) of the position encoder movement may correspond to closure travel between an approximate midpoint and an upper limit position, and the second sector (also, less than a half revolution) may correspond to closure travel between the approximate midpoint and a lower limit position.

In a preferred form, the relative position encoder and the absolute position encoder are mounted for rotation around two axes that are mutually perpendicular, or approximately so. The encoders may be mutually coupled by way of suitable gear means, such as worm gear means, a shaft of the relative position encoder associated with a worm gear, driving a worm wheel associated with a shaft of the absolute position encoder.

BRIEF DESCRIPTION OF THE DRAWINGS

By way of example, a preferred embodiment of the invention will now be further explained and illustrated by reference to the accompanying drawings, in which.

DETAILED DESCRIPTION OF THE DRAWINGS

Figure 1:
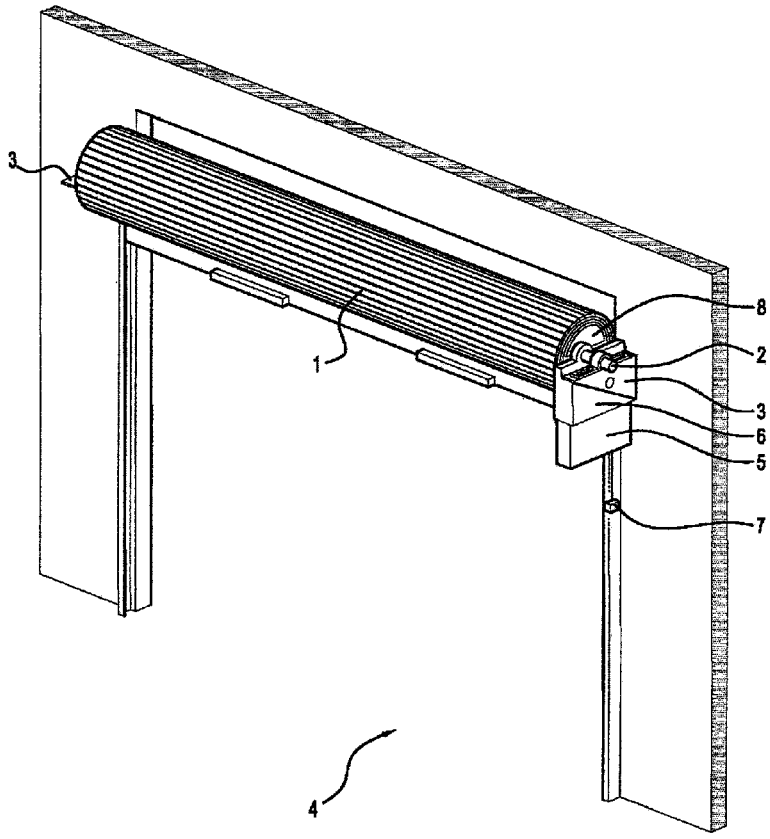
FIG. 1 shows an installed roller door and operator.
Figure 2:
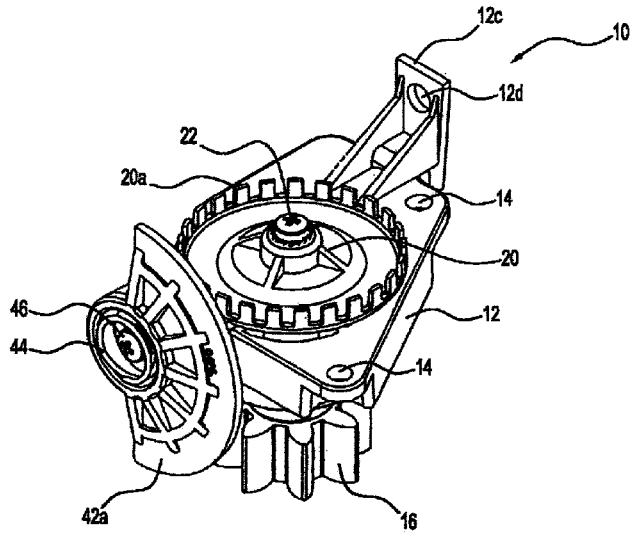
FIG. 2 is a perspective view from above of a device for use in controlling a roller door in accordance with the present invention.
Figure 3:
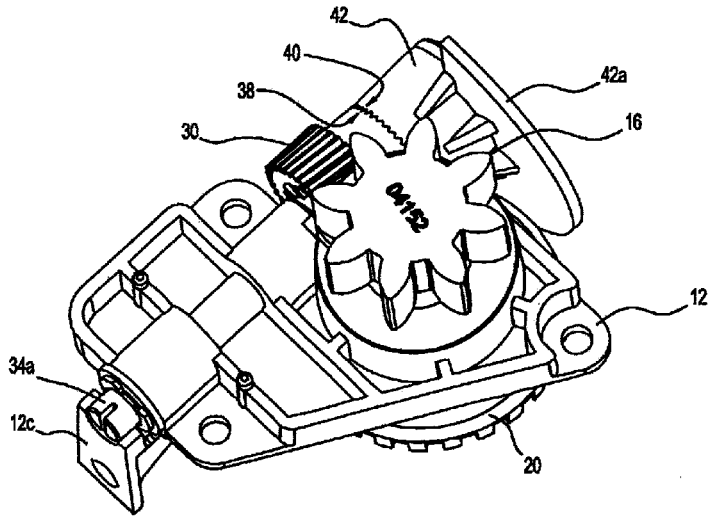
FIG. 3 is a perspective view from below of the device of FIG. 2.
Figure 4:
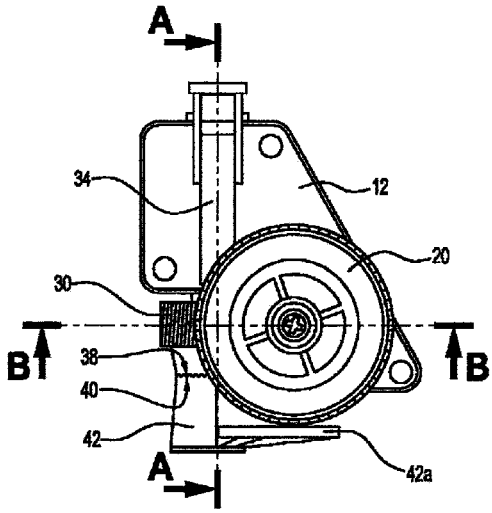
FIG. 4 is a top plan view of the device of FIG. 2.
Figure 5:
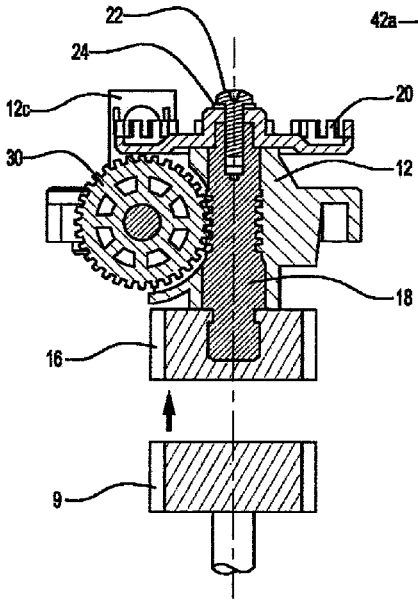
FIG. 5 is a cross-sectional view of the device taken through the line B-B in FIG. 4.
Figure 6:
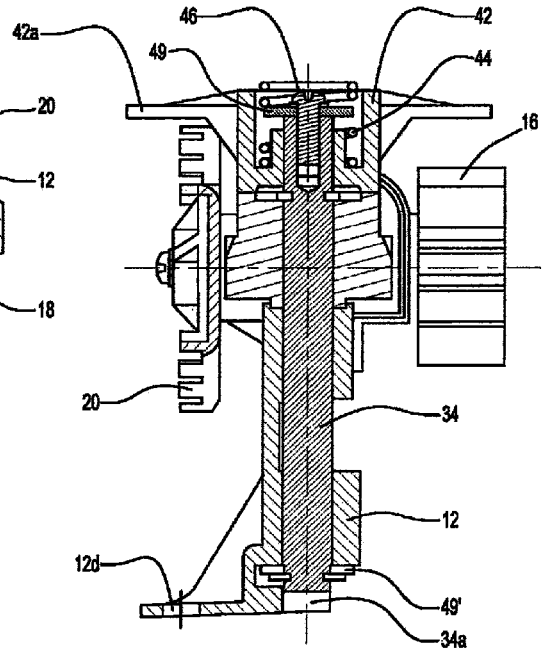
FIG. 6 is a cross sectional view of the device taken through the line A-A in FIG. 4.

A timing assembly device 10 for monitoring movement of a movable closure is illustrated in FIGS. 2-7. The device 10 is used in conjunction with a power operated door, such as a roller door 1 arranged for rotation about an axis 2 supported on side mounting brackets 3 in order to open and dose entrance 4 (FIG. 1). The function of device 10 is to identify the instantaneous position and/or velocity of roller door 1. Knowledge of such parameters is necessary to feed back as input to the electronic controller 5 of door operator 6 which controls the motor drive to roller door 1. Roller door 1 comprises a flexible curtain mounted at each end to a cylindrical drum 8, which by means of internal teeth is arranged to be driven by way of a gear assembly 9 from the electric motor (not shown) within operator 6. Handle 7 can be manipulated by an installer or user to selectively mechanically disengage and re-engage the motor of operator 6 from drum 8, so that that roller door may be manually moved, eg. in the event of a power failure.

The components of device 10 include support mounting 12, mountable within door operator 6 by means of screw holes 14. In place, a follower gear 16 becomes operatively coupled to the internal teeth of gear drum 8. Follower gear 16 in turn is fixedly mounted to the lower end of a worm shaft 18, which is arranged for rotation within mounting bore 12*a*.

A timing wheel 20 is fixedly attached to the upper end of the worm shaft 18 by way of screw 22 and tooth lock washer 24. Timing wheel 20 comprises a disc-shaped body with regular teeth 20*a* projecting from the circumference in an axial direction as shown, to provide a cutter element of a bi-phasic opto-encoder (see below). The motion of gear drum 8 is thus directly coupled to cause rotation of the worm gear of worm shaft 18 and timing wheel 20, so that rotation of the roller door translates directly into output pulses from the encoder, whether or not the operator motor is driving the roller door. For example, the relationship may be 1 tooth (ie a single pulse) per millimetre of movement of the roller door.

Figure 7:
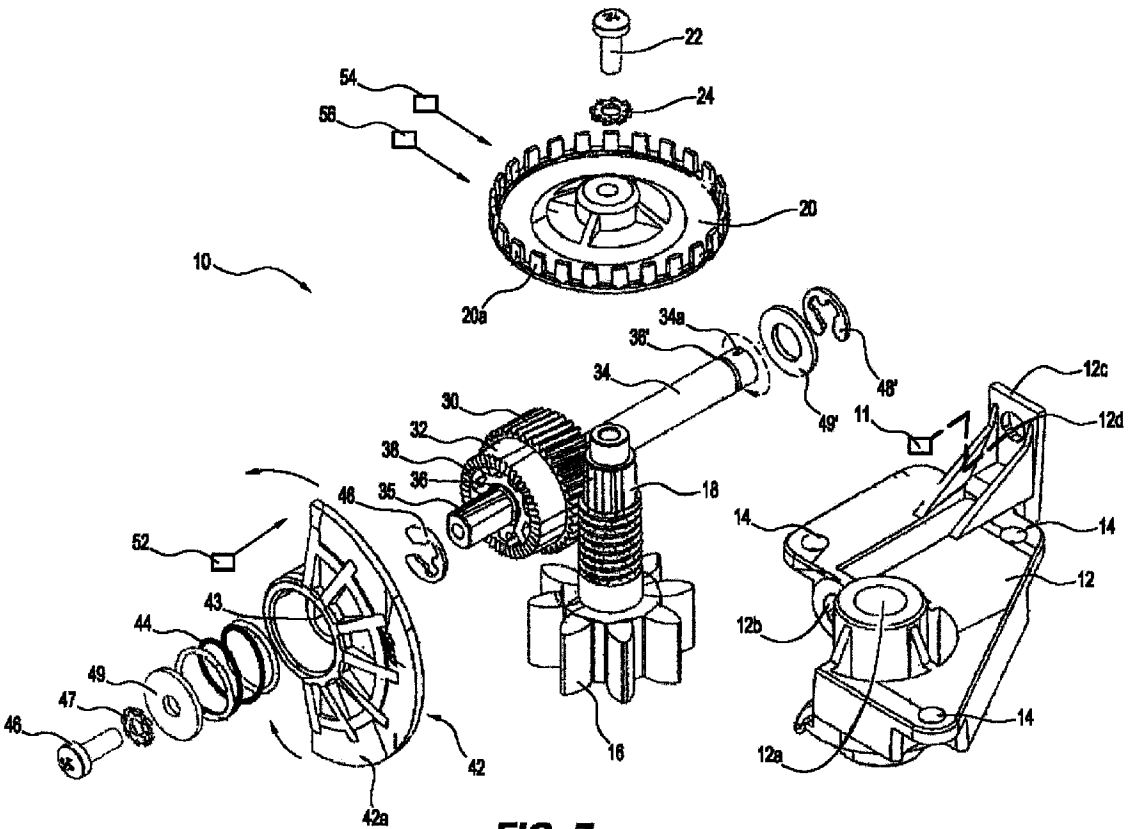
FIG. 7 is an exploded view of the device of FIG. 2 illustrating the component parts thereof.

The worm gear of worm shaft 18 mesh with teeth 30 of a helical gear element 32 (a worm wheel) as shown in FIG. 7. Helical gear element 32 is mounted for free rotation about a ratchet shaft 34, which is arranged for rotation within mounting bore 12*b*. Mounting bores 12*a* and 12*b* (and therefore worm shaft 18 and ratchet shaft 34) are mutually perpendicular. Ratchet shaft 34 features annular slots 36 and 36' adjacent each end. The proximal end face is provided with a diametric slot 34*a*, and the distal end section 35 has a flat-faced key cross-section and a threaded axial end bore, as shown. The proximal end of shaft 34 is accessible from the underside of the operator from the outside of the operator, in order to allow adjustment (see below).

The worm gear arrangement is employed as it can provide power transmission at substantial speed reduction and torque multiplication in a comparatively small design package, while affording minimum backlash and maximum accuracy of position.

On its end face, helical gear element 32 features an axially-directed set of inclined-face ratchet teeth 38. A complementary set of inclined-face ratchet teeth 40 (see FIG. 3, 4) are provided on the end face of a ratchet datum wheel element 42. Ratchet datum wheel element 42 is generally tubular, with a flat-faced key bore 43 therethough. At the opposite end, element 42 is provided with a radially projecting flange 42*a* of substantially semi-circular form as shown, which serves as the datum wheel (see below).

By means of screw 46, tooth lock washer 47, plastic washer 49 and compression spring 44, ratchet datum wheel element 42 is fixed to the distal end 35 of shaft 34 so that they will rotate in unison (due to the keyed cross sections of shaft end section 35 and bore 43), but element 42 is able to move a limited distance in the distal direction against the force of spring 44. Helical gear element 32 is free to rotate around ratchet shaft 34, but held against axial movement in the distal direction by circlip 48 engaged in annular slot 36. Once shaft 34 is in position in mounting bore 12*b*, it is held against axial movement by means of circlip 48' engaged in annular slot 36', and plastic washer 49'.

Rotation of follower gear 16 thus rotates worm shaft 18, which drives helical gear element 32, which drives (via the engaged sets of ratchet teeth 38, 40) ratchet datum wheel element 42. This in turn has the effect of rotating shaft 34. Spring 44 acts as a biasing means to hold ratchet teeth 38, 40 in engagement during normal operation. When the drive is at rest, selectively rotating shaft 34 by use of a screwdriver in proximal slot 34*a* results in overcoming the engagement of teeth 38, 40 and in the slippage of ratchet datum wheel element 42 against helical gear element 32, the ratchet teeth disengaging against the bias force of spring 44. Without requiring any loosening, unscrewing or other dismantling, this provides a simple adjustment of the position of the datum wheel 42*a*, without affecting the position of any of the other timing components. Once adjustment is completed, the integrity of the timing assembly and its ability to move without any slippage or play is unaffected.

In normal operation, rotation of the roller door translates directly into (relatively slow) rotation of datum wheel 42*a*. The relative gearing of the components of device 10 are selected such that the semicircular flange 42*a* forming the datum wheel corresponds to an extent of travel somewhat less than half of the total travel of roller door 1. In other words, the gearing is such that one revolution of datum wheel element 42 corresponds to a closure travel greater than the total closure travel (ie the distance between the upper and lower travel limits). For a larger closure involving a greater distance between limits, a different gearing would be required.

An optical sensor (ie. a light beam device), schematically depicted at 52, is positioned to be interrupted by datum wheel 42*a*, while two similar sensor devices 54, 56 are positioned to be interrupted by teeth 20*a* of timing wheel 20. Two such optical devices are required for the timing encoder as it is necessary to count pulse rate and direction of motion of wheel 20. The optical sensors 52, 54, 56 are connected to appropriate circuitry (not shown), and the circuitry and sensors are mounted on an encoder PCB (not shown), in electrical connection with the circuitry of motor drive controller 5.

The setup of device 10 will now be described. This setup is carried out at installation of the operator unit, and when service or refitting is carried out, if required. With the drive disengaged (by means of handle 7), the roller door is moved manually to the approximate midpoint of its travel between the open and closed positions, which represents the sole datum point of the closure. Optical device 52 is arranged to provide a visual indication to an operator when it is interrupted by the datum wheel 42*a*. This is achieved by arranging and connecting an LED 11 on the encoder PCB, the LED 11 to be viewed through aperture 12*d* in bracket 12*c* projecting from support mounting 12, so as to be readily viewable to the operator carrying out the setup. Shaft 34 is then rotated (and the operator will hear and feel the ratchet action between the teeth sets 38 and 40) until the LED 11 switches on or off, thus indicating that the radial cutter edge of datum wheel 42*a* is just at the point of cutting the light beam.

The datum wheel is now set. It will be realised that through one half of the door travel, the light beam of device 52 will be interrupted, and for the other half, there will be no interruption. Effectively, then, rotating datum wheel 42*a* provides an absolute encoder to identify the sector of travel of the door. The operator then goes through the steps of setting the required upper and lower limits of the door travel, which will not be described in further details here. By means of the timing wheel, the relative positions of the door travel limits from the absolute datum (being the approximate midpoint of the door travel) are stored in the operator controller memory.

Knowledge of the position of the door (as being in either the upper or lower half of its travel) is thus provided to the controller, along with the direction and velocity information identified by the timing wheel 20 as input to its drive motor operating algorithms.

During normal use of the roller door, disengaging the motor drive from the door for manual operation does not interrupt the position monitoring by the controller, as timing wheel 20 rotates with the door. However if the absolute position is lost to the controller (which will happen in the case of loss of power to the operator), it is necessary to re-establish absolute position. When power is restored to the operator, the controller does not know what position the door is in, as it may have been manually moved during the power-down period. Instructions cannot be accepted from the operator's remote control unit before the door position is reestablished.

The controller is programmed simply to re-establish absolute position by use of the device of the invention, as follows. By means of the absolute position encoder (datum wheel 42*a* and its optical sensor) the controller immediately establishes whether the wheel is in the upper or lower half. The controller is programmed then to move the door in the safe operating direction, ie. toward the datum point (the approximate closure midpoint, corresponding to the datum wheel sector transition point). On reaching this point, absolute position is then re-established, and normal operation of the door can then be resumed.

As will be clear to the skilled reader, the present invention provides an extremely simple, compact and robust position monitoring device for use in an operator of any type of movable closure. The device employs few component parts and very few moving parts, when compared with similar devices in the prior art. Importantly, only three optical encoders are required. Although the datum wheel of the preferred embodiment of the present invention provides, in effect, only a single bit gray code, this is sufficient to provide the required function and operation. Further, no unscrewing or other partial or complete disassembly of parts is required to adjust the absolute position encoder, and so the integrity of operation is not affected by adjustment.

The components of the assembly 10 of the invention are manufactured from suitable plastics or metal materials. For example, worm shaft 18 is manufactured from brass, and ratchet shaft 4 from mild steel. Screws 22 and 46, washers 24, 47, 48, 48', 49, 49', and compression spring 44 are all manufactured from mild steel. All the other components, including support mounting 12, are manufactured from a suitable engineering polymer, such as Dupont's Delrin™, an acetal self-lubricating plastics material, which is lightweight but durable and has suitable low wear and low friction properties.

Modifications and improvements to the invention will be readily apparent to those skilled in the art. Such modifications and improvements are intended to be within the scope of this invention. For example, rather than featuring a 180° radially extending flange, the datum wheel may feature another form of projection, or alternative means for interracting with the encoder circuitry. Instead of optical sensors, one or more of the encoders may feature a microswitch, a magnetic sensor, or any other suitable form of sensor.

The word 'comprising' and forms of the word 'comprising' where used in this description and claims are not to be read as limiting the invention claimed to exclude any variants or additions.

The invention claimed is:

1. A device for operating a movable closure in travel between limit positions, the device including an apparatus for monitoring motion of the movable closure between said limit positions, the apparatus comprising:

an absolute position encoder for identifying whether the closure is in one of a plurality of sectors of travel between the limit positions, the absolute position encoder arranged for rotation with the movable closure;

a relative position encoder for monitoring the speed and relative position of the closure, the relative position encoder arranged to convert rotational motion into a sequence of pulses; and an encoder drive for operatively coupling the relative position encoder and the absolute position encoder to the closure, such that during operation there is a fixed relationship between motion of the closure and movement of both encoders;

wherein the absolute position encoder includes an adjustment assembly comprising a first element arranged always to rotate with the absolute position encoder and a second element arranged always to rotate with the relative position encoder, the first element being selectively adjustable in rotational position relative to the second element to allow adjustment of the position of the absolute position encoder without movement of the encoder drive or the relative position encoder; and wherein the device further comprises a gear assembly for transferring drive torque to the movable closure and the adjustment assembly does not form part of the gear assembly.

2. A device according to claim 1, wherein the adjustment assembly includes clutch means affording disengagement of the first element from operative engagement with the second element and means for rotating the first element.

3. A device according to claim 2, wherein the clutch means includes a ratchet assembly having two sets of complementary interlocking teeth respectively on the first and second element, held in meshing engagement by a spring means.

4. A device according to claim 3, wherein the means for rotating the first element includes a shaft arranged for fixed rotation with the first element, the shaft including a means for manual rotation by a user.

5. A device according to claim 1, wherein the absolute position encoder is configured to identify whether the closure is in one of two sectors of travel, a first and a second sector.

6. A device according to claim 1, wherein the absolute position encoder includes a rotatable body and a projection from a part of the body, said projection associated with a sensor.

7. A device according to claim 6, wherein the projection is a flange projecting radially from a part of the circumference of the body.

8. A device according to claim 7, wherein the flange is of a substantially semicircular form so as to occupy around 180 degrees of the circumference of the body, to divide the closure travel into a first and a second sector.

9. A device according to claim 5, wherein the absolute position encoder is configured such that a full revolution of the absolute position encoder corresponds to travel of the movable closure over a distance greater than the distance between the closure limit positions, the first sector corresponding to closure travel between an approximate midpoint and an upper limit position, and the second sector corresponding to closure travel between the approximate midpoint and a lower limit position.

10. A device according to claim 1, further including indicating means for indicating to a user when the first element of the absolute position encoder has been adjusted into a particular orientation.

11. A device according to claim 10, wherein the indicating means comprises an LED or other visual indicator coupled to the sensor and configured to light upon detection of a particular orientation of the absolute position encoder.

12. A device according to claim 11, wherein the particular orientation is the alignment of the sensor with an edge of the projection from the absolute position encoder body to thereby indicate a sector transition.

13. A device according to claim 1, wherein the relative position encoder and the absolute position encoder are mounted for rotation around two substantially mutually orthogonal axes.

14. A device according to claim 1, wherein the two encoders are mutually coupled by way of gear means.

15. A device according to claim 14, wherein the gear means comprises a worm gear associated with a shaft of the relative position encoder, the worm gear driving a worm wheel associated with a shaft of the absolute position encoder.

16. A device according to claim 1, wherein the relative position encoder is a toothed wheel associated with at least one optical sensor.

17. A movable closure system including a movable closure and a device according to claim 1.

18. A device according to claim 8, wherein the absolute position encoder is configured such that a full revolution of the absolute position encoder corresponds to travel of the movable closure over a distance greater than the distance between the closure limit position, the first sector corresponding to closure travel between an approximate midpoint and an upper limit position, and the second sector corresponding to closure travel between the approximate midpoint and a lower limit position.

* * * * *